US009952559B2

(12) United States Patent
Dolce et al.

(10) Patent No.: US 9,952,559 B2
(45) Date of Patent: Apr. 24, 2018

(54) SYSTEM FOR FASTENING GEMS TO A WATCH DIAL AND A WATCH PROVIDED WITH SUCH A SYSTEM FOR FASTENING GEMS

(71) Applicant: Dolce & Gabbana S.R.L., Milan (IT)

(72) Inventors: Domenico Dolce, Milan (IT); Stefano Gabbana, Milan (IT)

(73) Assignee: DOLCE & GABBANA S.R.L., Milan (IT)

( * ) Notice: Subject to any disclaimer, the term of this patent is extended or adjusted under 35 U.S.C. 154(b) by 374 days.

(21) Appl. No.: 14/895,577

(22) PCT Filed: Aug. 5, 2014

(86) PCT No.: PCT/IB2014/063704
§ 371 (c)(1),
(2) Date: Dec. 3, 2015

(87) PCT Pub. No.: WO2015/019282
PCT Pub. Date: Feb. 12, 2015

(65) Prior Publication Data

US 2016/0139566 A1 May 19, 2016

(30) Foreign Application Priority Data

Aug. 5, 2013 (IT) ..... MI2013A1343

(51) Int. Cl.
*G04B 19/10* (2006.01)
*G04B 47/04* (2006.01)

(52) U.S. Cl.
CPC ..... *G04B 47/042* (2013.01); *G04B 19/10* (2013.01); *G04B 19/103* (2013.01)

(58) Field of Classification Search
CPC ..... G04B 19/06; G04B 19/10; G04B 19/12; G04B 19/103; G04B 47/042
See application file for complete search history.

(56) References Cited

U.S. PATENT DOCUMENTS 3,677,793 A 7/1972 Blösch
4,473,306 A * 9/1984 Lederrey ..... G04B 47/042 368/285

(Continued)

FOREIGN PATENT DOCUMENTS

EP 0 098 240 1/1984
FR 2 033 342 12/1970

(Continued)

OTHER PUBLICATIONS

International Search Report dated Sep. 10, 2015.

*Primary Examiner* — Vit W Miska
(74) *Attorney, Agent, or Firm* — Jacobson Holman, PLLC.

(57) ABSTRACT

In order to make a system for fastening gems to a watch dial, the dial is made of an upper plate-shaped element and of a lower plate-shaped element facing each other, the upper plate-shaped element being provided with openings for housing the gems in a visible manner and the lower plate-shaped element being provided with openings at the openings of the upper element and having the same size as these latter. Each of the openings mutually facing by pairs extends across the thickness of the respective plate-shaped element with an own peripheral edge inclined so that each opening narrows, within the section of the respective plate-shaped element, going from the surface of the plate-shaped element facing the other plate-shaped element towards the opposite surface thereof for forming a seat for housing and retaining a gem between the two elements.

13 Claims, 3 Drawing Sheets

(56) References Cited

U.S. PATENT DOCUMENTS

| | | | | | |
|---|---|---|---|---|---|
| 4,558,955 | A * | 12/1985 | Herchenbach | G04B 37/1486 | 368/282 |
| 5,119,350 | A * | 6/1992 | Delacretaz | A44C 17/0258 | 368/223 |
| 6,491,424 | B1 * | 12/2002 | Tardy | G04B 39/00 | 368/283 |
| 2011/0069590 | A1 * | 3/2011 | Jolidon | G04B 19/16 | 368/15 |
| 2013/0070573 | A1 * | 3/2013 | Oshio | G04B 19/10 | 368/235 |
| 2015/0359303 | A1 * | 12/2015 | Lebreton | A44C 17/02 | 368/168 |

FOREIGN PATENT DOCUMENTS

| | | |
|---|---|---|
| FR | 2 970 901 | 8/2012 |
| WO | 2008/144948 | 12/2008 |

* cited by examiner

SYSTEM FOR FASTENING GEMS TO A WATCH DIAL AND A WATCH PROVIDED WITH SUCH A SYSTEM FOR FASTENING GEMS

The present invention refers to an innovative system for fastening gems to a watch dial.

BACKGROUND OF THE INVENTION

In the field of watchmaking watches are made, the dial of which is decorated with stones or gems having various shapes, colour and optical characteristics (clarity, light refraction capability, etc.).

Such gems are generally fixed to the dial through the known setting methods that are used for jewels, like rings, bracelets, necklaces, etc., i.e. fixedly attaching the gem to the seat in which it is housed (setting) through glues or suitable retention elements (griffes) that hold it in the setting in a substantially irreversible manner.

For this reason, removal of the gem from the setting (so as to be replaced or for other reasons related to maintenance of the watch dial) can be very difficult indeed due to the type of fastening means used.

These fastening systems, moreover, in addition to being delicate, complex and laborious to be made and requiring a large number of components (in the case wherein griffes or similar retention elements are used), do not ensure that the gem is securely fastened, because the glues can deteriorate and become less effective and the retention elements can become damaged, for example due to welding defects or in case of bumps.

BRIEF SUMMARY OF THE INVENTION

The general purpose of the present invention is to avoid the drawbacks mentioned above by providing an innovative system for fastening gems to a watch dial, which is simple and cost-effective to be made and wherein the gems are held in position in a fixed and secure manner, but can be easily removed when required. In view of such a purpose it has been devised, according to the invention, a system for fastening gems to a watch dial provided with one or more gems, the fastening system comprising said dial and gems, characterised in that the dial is made of an upper plate-shaped element and of a lower plate-shaped element facing each other, the upper plate-shaped element being provided with one or more openings for housing a respective gem in a visible manner and the lower plate-shaped element being provided with one or more openings at the one or more openings of the upper plate-shaped element and having the same size as these latter, each of the openings, facing one another by pairs, extending across the entire thickness of the respective plate-shaped element with an own peripheral edge which is inclined so that each opening narrows, within the section of the respective plate-shaped element, going from the surface of the plate-shaped element facing the other plate-shaped element towards the opposite surface thereof for forming a seat for housing and retaining a gem (14) between the two plate-shaped elements.

A watch has moreover been made, comprising a case, a dial provided with one or more gems, an upper glass for protection of the dial, a bottom for lower closure of the case, an adjustment crown and an assembly containing the watch movements, which is provided with such a system for fastening the gems to the dial.

BRIEF DESCRIPTION OF THE SEVERAL VIEWS OF THE DRAWINGS

In order to clarify the description of the innovative principles of the present invention together with its advantages with respect to the prior art, we shall describe in the following description, with the help of the attached drawings, a possible example embodiment in which such principles are applied. In the drawings.

DETAILED DESCRIPTION OF THE INVENTION

Figure 1:
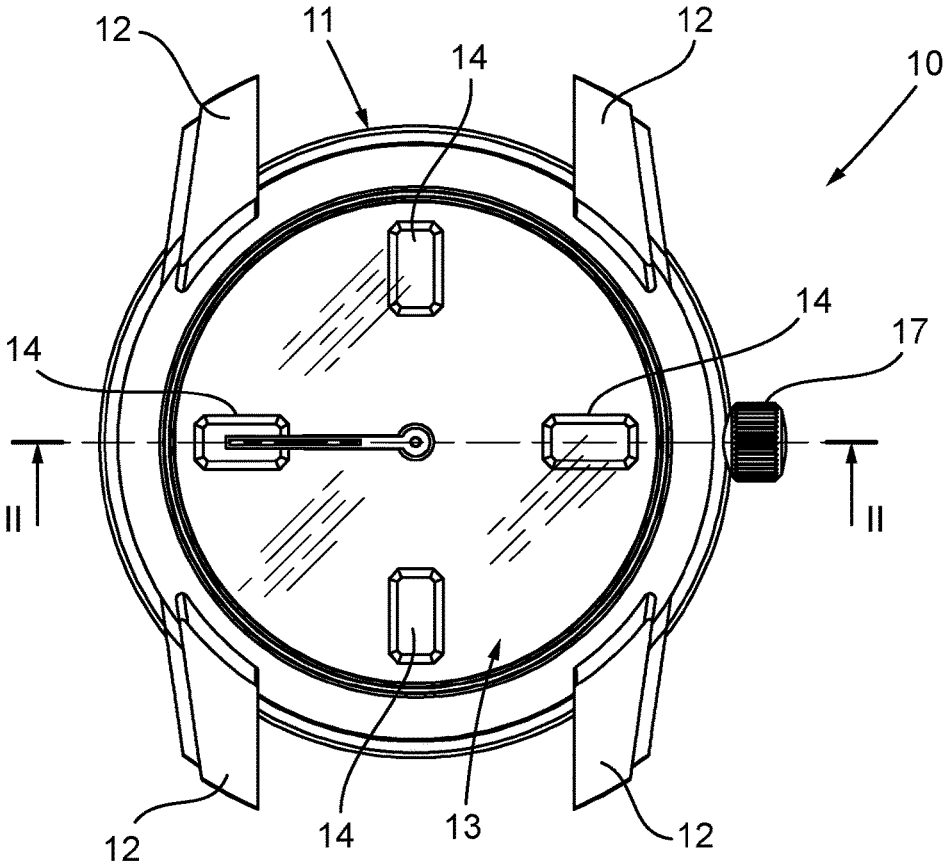
FIG. 1 represents a front view of a watch case with a dial provided with gems facing from the surface of the dial and fixed to it according to principles of the present invention.

With reference to the figures, FIG. 1 represents a watch 10 (in particular only the case 11 is illustrated, without the watch strap that can of course be fastened through known methods to the supports 12 projecting from the case) the dial 13 of which is provided, for decorative purposes, with one or more stones or gems 14. In the illustrated example, there are four gems that are positioned at 3, 6, 9 and 12 o'clock. Of course, the arrangement of the gems (just like their shape and sizes) can be different according to the desired appearance for the specific watch model.

Figure 2:
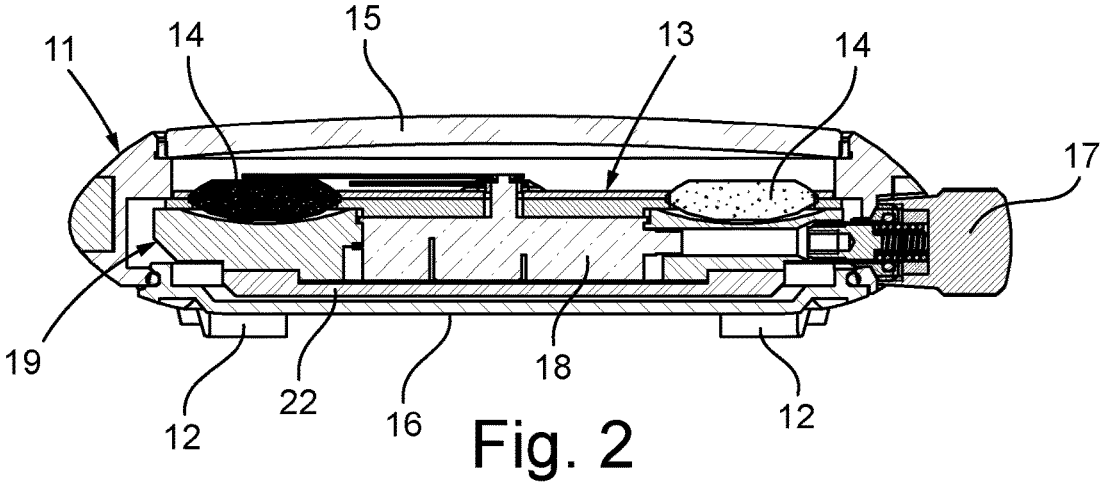
FIG. 2 represents a view of the watch, which is sectioned along the line II-II of FIG. 1.

As can be clearly seen in FIG. 2, the case 11 of the watch in conditions of use, is provided with normal components that are suitable for ensuring that the watch is suitably protected and functional, such as an upper glass 15, a bottom 16, an adjustment crown 17 and an assembly 18 containing the watch movements.

Figure 3:
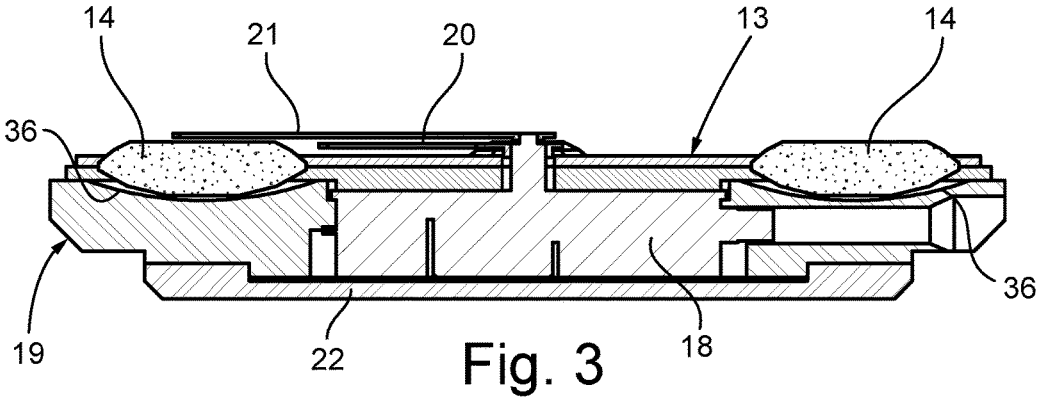
FIG. 3 represents an enlarged section view, similar to that of FIG. 2, but referring only to the internal components of the watch, extracted from the case.

FIG. 3 shows, through an even more enlarged view, some of the inner components of the watch, extracted from the case. In particular, it is possible to see the group formed by the assembly 19 for positioning and holding the gems, by the assembly 18 containing the watch movements, connected to the hands 20, 21, and by a disc 22 for closing the bottom and for holding the aforementioned components in position.

Figure 4:
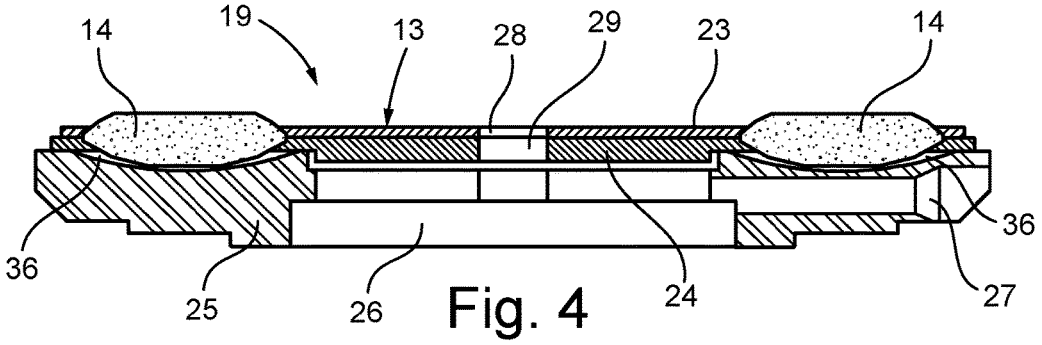
FIG. 4 represents a section view of the gem holding and positioning assembly.
Figure 5:
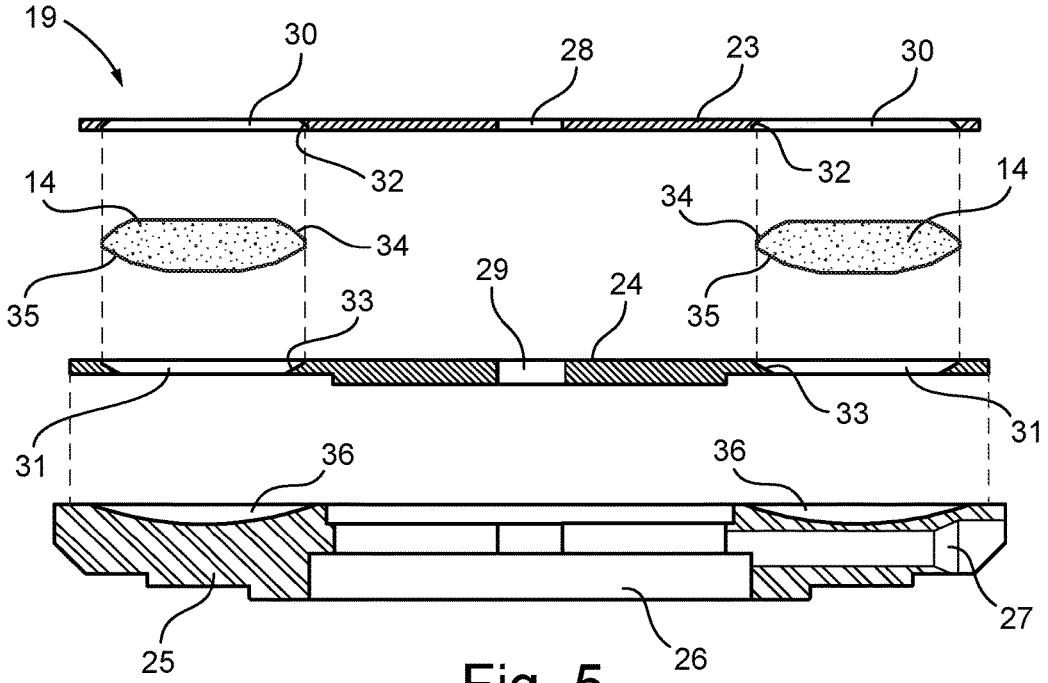
FIG. 5 represents an exploded view of the component elements of the gem holding and positioning assembly illustrated in FIG. 4.

The assembly 19 for positioning and holding the gems, shown in FIG. 4 in the assembled condition and in FIG. 5 in "exploded" condition, consists of an upper plate-shaped element 23, of a lower plate-shaped element 24 and of a lower body 25 for supporting and fastening said upper and lower plate-shaped elements in position. The upper plate-shaped element 23 and the lower plate-shaped element 24 substantially work together to form the dial 13 of the watch, wherein the upper surface of the upper plate-shaped element 23 makes up the visible surface of the dial itself.

The lower body 25 is advantageously ring-shaped, with a central hollow 26 that is suitable for housing, inside it, the assembly 18 containing the watch movements. Moreover, the lower body 25 is provided with a lateral seat 27 for housing the crown 17 and the relative kinematic connections with the assembly 18 of the watch movements.

The upper and lower plate-shaped elements, 23 and 24, respectively, are in turn provided with a respective central hole 28, 29 for passing the connections between the watch movements, contained in the assembly 18, and the hands 20, 21.

Figure 6:
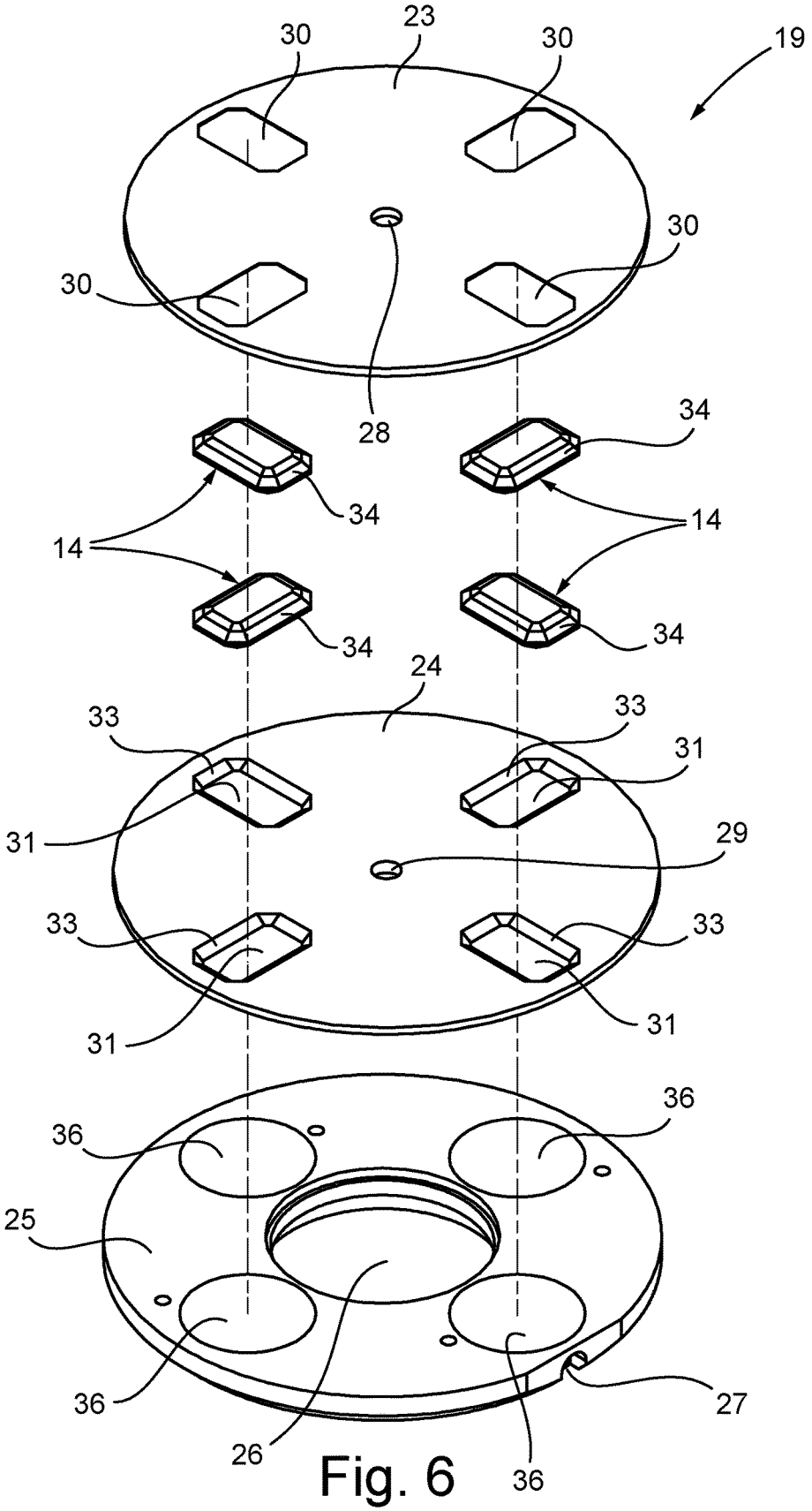
FIG. 6 represents an exploded view of the component elements of FIG. 5, but they are illustrated in a perspective view.

The elements that make up the gem holding and positioning assembly 19 are clearly visible also in the exploded perspective view of FIG. 6.

The upper plate-shaped element 23 is provided with a plurality of openings 30 at the positions where the gems 14 shall be visible on the dial of the watch.

The lower plate-shaped element 24 is provided with a plurality of openings 31 at the openings 30 of the upper plate-shaped element 23, having the same size as these latter.

The openings 30, 31 have a shape that matches the perimeter of the gems 14 intended to be housed in such openings.

As it can be clearly seen in FIG. 5 and, as far as the lower plate-shaped element 24 is concerned, also in FIG. 6, each of the openings 30 and 31, facing one another by pairs, extends across the thickness of the respective plate-shaped element 23, 24 with an own peripheral edge 32, 33 that is inclined so that each opening narrows, within the section of the respective plate-shaped element, going from the surface of the plate-shaped element facing the other plate-shaped element towards the opposite surface thereof.

In particular, the peripheral edges 32, 33 of the openings 30, 31 of the two plate-shaped, elements 23, 24 have the same inclination as corresponding upper and lower peripheral portions 34, 35 of the gems intended to be fastened to the dial in the seats formed by said openings 30, 31 facing each other.

In such a way, when the two plate-sharked elements 23, 24 are brought together in the assembled position with the gems in the respective seats (like in FIG. 4), the inclined peripheral edge 32 of the opening 30 of the upper plate-shaped element 23 rests on the upper peripheral portion 34 of the gem 14 and the inclined peripheral edge 33 of the opening 31 of the lower plate-shaped element 24 rests on the lower peripheral portion 35 of the gem, thus trapping the gem itself in the dial 13 which, as mentioned, is formed by the assembly of plate-shaped elements 23 and 24.

Advantageously, the aforementioned peripheral portions 34, 35 of the gem match the inclined peripheral edges 32, 33 of the plate-shaped elements 23, 24 along the entire perimeter of the gem.

The lower body 25 intended to support and fasten, in position, the plate-shaped elements 23, 24 that hold the gems in position is advantageously provided, at the position of the gems on the dial, with cavities 36 having a concave bottom that is mirror-polished by appropriate diamond tools.

One function of such, so finished, cavities 36 is that of collecting the light from the outside, which passes through the gem, and of reflecting it towards the gem itself, thereby making it particularly bright despite the fact that most of the gem body is actually within the watch, below the surface of the dial.

In practice, thanks to this solution (which is possible because the gem is not set in the dial, but simply held along its peripheral edge), under favourable lighting conditions the gem can shine as if it were provided with a luminous source arranged, inside the case of the watch.

Again to emphasise this optical characteristic, the depth and the shape of the cavities 36 are such that their bottom is always suitably spaced away from the gem.

At this stage it is clear how the solution according to the present invention achieves the purposes proposed above.

Indeed, the gems are held in position in a fixed and secure manner, thanks to the fact that they are trapped between the two plate-shaped elements that form the dial. However, they can be easily removed when necessary, by simply disassembling the dial by separating the aforementioned plate-shaped elements.

Moreover, specific retention elements are not required (such as griffes or the like), which would make manufacturing of the watch more complex and expensive. Moreover, thanks to the presence of the cavities 36, it is possible to house the gems in a sunker position inside the watch dial, thus minimising the protrusion of the gems themselves above the visible surface of the dial, towards the space engaged by the rotation of the hands. The cavities 36, indeed, constitute a housing seat, for a part of the gem body arranged below the dial.

Of course, the above description of an embodiment applying the innovative principles of the present invention is given as an example of such innovative principles and should not be taken to limit the scope of protection claimed hereby.

For example, the cavities 36 (which are shown with a circular shape here, irrespective of the shape of the gems) could also have a different shape, in particular a shape matching that of the gems themselves. Of course, an embodiment with a predetermined circular shape, like the one shown here, has the advantage of adapting to basically any shape of gem by using a single type of lower body 25 and, therefore, with a consequent saving in the production phase.

The number of the openings 30, 31 present in the two plate-shaped elements 23, 24 obviously depends upon the number of gems to be applied, to the dial, therefore, in the case of a watch that, is characterised by having only one gem, there will be a single pair of facing openings 30, 31 instead of a plurality as shown as an example in the attached drawings.

The invention claimed is:

1. A system for fastening gems to a watch dial provided with one or more gems, the fastening system comprising said dial and gems, wherein the dial is made of an upper plate-shaped element and of a lower plate-shaped element facing each other, the upper plate-shaped element being provided with one or more openings for housing a respective gem in a visible manner and the lower plate-shaped element being provided with one or more openings at the one or more openings of the upper plate-shaped element and having the same size as these latter, each of the openings, facing one another by pairs, extending across the entire thickness of the respective plate-shaped element with an own peripheral edge which is inclined so that each opening narrows, within the section of the respective plate-shaped element, going from the surface of the plate-shaped element facing the other plate-shaped element towards the opposite surface thereof for forming a seat for housing and retaining a gem between the two plate-shaped elements.

2. The system for fastening gems to a watch dial according to claim 1, wherein the openings have a shape matching the perimeter of the gems intended to be housed in such openings.

3. The system for fastening gems to a watch dial according to claim 1, wherein the peripheral edges of the openings of the two plate-shaped elements have the same inclination as corresponding upper and lower peripheral portions of the gems intended to be fastened to the dial in the seats formed by said openings facing each other.

4. A holding assembly for gem positioning, said assembly being formed by a system for fastening gems to a watch dial according to claim 1 and by a lower body for supporting and holding the plate-shaped elements, such body being provided, at the position of the gems on the dial, with cavities having a concave bottom, designed to form a seat for receiving a part of the gem body arranged below the dial.

5. The holding assembly for gem positioning according to claim 4, wherein the bottom of the cavities is spaced apart from the body of the gems when these latter are positioned and held in the dial.

6. The holding assembly for gem positioning according to claim 4, wherein the bottom of the cavities is mirror-finished.

7. The holding assembly for gem positioning according to claim 4, wherein the cavities have a circular shape.

8. The holding assembly for gem positioning according to claim 4, wherein the lower body has an annular shape, with a central hollow suitable for housing inside it an assembly containing watch movements.

9. The holding assembly for gem positioning according to claim 8, wherein the plate-shaped elements are provided with a respective central hole for the passage of connections between the watch movements, contained in said assembly designed to be housed in the central hollow of the lower body, and hands when mounted on the dial.

10. A watch system comprising a holding assembly for gem positioning according to claim 8, wherein it comprises a lower disc for holding the gem holding and positioning assembly and the assembly containing the watch movements.

11. A watch comprising a case, a dial provided with one or more gems, an upper glass protection of the dial, a bottom for lower closure of the case, an adjustment crown and an assembly containing watch movements, wherein it comprises a system for fastening gems to the dial according to claim 1, and a holding assembly.

12. A watch comprising a case, a dial provided with one or more gems, an upper glass for protection of the dial, a bottom for lower closure of the case, an adjustment crown and an assembly containing the watch movements, wherein it comprises a system for fastening gems to the dial and a holding assembly according to claim 9.

13. A watch comprising a case, a dial provided with one or more gems, an upper glass for protection of the dial, a bottom for lower closure of the case, an adjustment crown and an assembly containing the watch movements, wherein it comprises a system for fastening gems to a dial, a holding assembly, and a watch system according to 10.

* * * * *